US007757686B2

(12) United States Patent
Guzorek

(10) Patent No.: US 7,757,686 B2
(45) Date of Patent: Jul. 20, 2010

(54) VENT ASSEMBLY FOR COMBUSTION GASES GENERATED BY AN APPLIANCE

(75) Inventor: Steven E. Guzorek, Kinston, NC (US)

(73) Assignee: Field Controls, LLC, Kinston, NC (US)

( * ) Notice: Subject to any disclaimer, the term of this patent is extended or adjusted under 35 U.S.C. 154(b) by 259 days.

(21) Appl. No.: 11/366,128

(22) Filed: Mar. 2, 2006

(65) Prior Publication Data

US 2007/0204773 A1 Sep. 6, 2007

(51) Int. Cl.
*F23J 13/02* (2006.01)

(52) U.S. Cl. ..... 126/307 R; 126/307 A; 126/312; 126/316; 110/147; 110/160; 110/162; 454/1; 454/3; 454/251

(58) Field of Classification Search ..... 126/307 A, 126/307 R, 312, 293, 301, 21 R, 27, 31, 69, 126/74, 75, 78, 80, 517, 299 D, 290, 292, 126/316, 85 B, 83; 110/163, 162, 147, 160, 110/320; 454/1, 3, 252, 51, 243, 43; 122/18.2, 122/156, 18.1, 15.1; 236/45; 237/55
See application file for complete search history.

(56) References Cited

U.S. PATENT DOCUMENTS 1,979,865 A * 11/1934 Chadwick et al. ..... 126/285 R
2,687,256 A * 8/1954 Puffer ..... 236/45
2,711,683 A * 6/1955 Ryder ..... 454/8
2,888,911 A * 6/1959 Thompson ..... 122/18.1
3,199,504 A * 8/1965 Morin, Jr. et al. ..... 126/91 R
4,335,704 A * 6/1982 Wingstrom et al. ..... 126/293
4,920,866 A * 5/1990 Hoban ..... 454/43
5,228,413 A * 7/1993 Tam ..... 122/15.1
6,289,886 B1 * 9/2001 Radke ..... 126/85 B
6,543,437 B1 * 4/2003 Luu et al. ..... 126/85 B

* cited by examiner

*Primary Examiner*—Steven B McAllister
*Assistant Examiner*—Avinash Savani
(74) *Attorney, Agent, or Firm*—Wood, Phillips, Katz, Clark & Mortimer

(57) ABSTRACT

The combination of a vent assembly with a conduit assembly bounding a flow space into which discharged combustion gases are exhausted. The conduit assembly has a first conduit length in which: a) combustion gases are communicated in a first direction in a first path between the flue outlet and a vent outlet; and b) backflow is communicated in the first path in a direction opposite to the first direction. The conduit assembly has a draft control assembly, with a conduit portion defining a flow passage in which backflow is diverted out of the first path. The draft control assembly further has a flow guide assembly that intercepts and guidingly diverts the backflow into the conduit portion to be exhausted.

24 Claims, 9 Drawing Sheets

28
VENT OUTLET
102

140
108
142
134
106
104
100
112
182
182
128
106
122
170
L
108
112
116
144
128
136
114
128'
C
20
124
138
120
118
166
108
12
108
38
14
COMBUSTION CHAMBER

VENT ASSEMBLY FOR COMBUSTION GASES GENERATED BY AN APPLIANCE

BACKGROUND OF THE INVENTION

1. Field of the Invention

This invention relates to appliances and, more particularly, to a vent assembly for controllably discharging combustion gases generated through operation of these appliances.

2. Background Art

Many different vent assemblies currently exist for controllably discharging combustion gases generated by fuel burning appliances. Several variations of these vent assemblies are used, for example, on water heaters.

In one known construction, a hood at the inlet to a vent conduit is situated directly above a flue outlet in de-coupled relationship. That is, there is a gap between the flue outlet and the vent pipe inlet. This design has the advantage that backflow/downdraft pressure is dissipated by reason of the backflow being able to disburse around the hood at the vent pipe inlet without creating a detrimental capping pressure at the flue outlet. In the absence of controlling this capping pressure, combustion within the appliance may be adversely affected. In a worst case, flame-out could occur.

One disadvantage with the above hood construction is that the draft height is less than it would be with the vent pipe inlet directly connected to the flue outlet so that there is a continuous passage created between the combustion location and the vent pipe discharge location.

Depending upon the balance between the exhausting gas and backflow pressures, there is also a possibility that a significant volume of combustion gases may detrimentally leak into the space within which the appliance is operated.

As an alternative to the above hood construction, it is known to directly connect the flue outlet to the vent pipe inlet and to incorporate a flow/draft control assembly. The flow control assembly typically is a conduit portion that is. "T'ed" into the vent pipe to produce a diversionary path transverse to the main flow path of combustion gases from the appliance to the discharge location. The conduit portion generally has a configuration the same as the vent pipe from which it originates. The conduit portion will typically have a closure plate that pivots between opened and closed positions and is normally urged into the closed position.

As the appliance is operated and draft generated in the vent pipe, a low pressure region is created in the conduit portion that tends to urge the closure plate towards its open position and draw intake/dilution air from the space within which the appliance is operated. This intake/dilution air mixes with the discharging combustion gases and assists draft development to contribute to efficient venting of the appliance.

The conduit portion is also designed to relieve backflow pressure by allowing a limited passage thereof into the space in which the appliance is operated. The backflow impinges upon the closure plate to urge it towards the open position.

While the conduit portion does relieve to some extent the capping pressure at the flue outlet, the capping pressure is generally substantially higher than that encountered using the aforementioned hood construction. Thus, this system is prone to being adversely affected by backdraft conditions and flame-out.

The industry continues to seek out systems that will generate draft that contributes to efficient venting of the appliance, without experiencing adverse effects from backflow. Ideally, these goals are achieved without any significant diffusion of combustion gases into a space within which the appliance is located and operated.

SUMMARY OF THE INVENTION

In one form, the invention is directed to the combination of an appliance that produces combustion gases during operation thereof and having a flue outlet through which the combination gases are discharged from the appliance, and a vent assembly. The vent assembly has a conduit assembly bounding a flow space into which discharged combustion gases from the flue outlet are communicated and from which the discharged combustion gases are exhausted through a vent outlet to a first location. The conduit assembly has a first conduit length in which: a) the combustion gases are communicated in a first direction in a first path between the flue outlet and the vent outlet; and b) backflow is communicated in the first path in a direction opposite to the first direction. The conduit assembly further has a draft control assembly with a conduit portion defining a flow passage in which backflow diverted out of the first path is exhausted to a second location. The draft control assembly further has a flow guide assembly within the flow space. The flow guide assembly intercepts backflow moving in the first path opposite to the first direction and guidingly diverts the backflow into the conduit portion to be exhausted to the second location.

In one form, the flow guide assembly has a curved surface that guides: a) the backflow from the first path into the flow passage in the conduit portion from where the backflow is exhausted to the second location; and b) intake air introduced at the second location into the flow passage in the conduit portion into the first conduit length where the intake air is mixed with combustion gases and moves with the combustion gases in the first path in the first direction.

In one form, the flow guide assembly includes a L-shaped conduit having first and second legs. The first leg resides in the flow space within the first conduit length. The second leg resides within the flow passage within the conduit portion.

The first leg has an outlet/inlet and the second leg has an inlet/outlet. In one form, the curved surface guides the backflow/intake air between the outlet/inlet and inlet/outlet.

The outlet/inlet may reside above the inlet/outlet.

In one form, the outlet/inlet has a cross-sectional area and a portion of the flow space within which the first leg resides has a cross-sectional area that is greater than the cross-sectional area of the outlet/inlet.

In one form, the outlet/inlet has a substantially circular cross-sectional configuration with a first central axis. The flow space has a substantially circular cross-sectional configuration where the first leg resides in the flow space. The first and second axes are substantially concentric.

In one form, the inlet/outlet has a first central axis and the flow passage has a second central axis, with the first and second central axes being spaced from each other.

In one form, the inlet/outlet and flow passage each has a substantially circular cross-sectional configuration.

The second central axis may reside below the first central axis.

In one form, the draft control further has flow plate that is pivotable about a third axis between a closed position and a first open position. The third axis is transverse to the second central axis.

The second central axis may reside below the third axis, whereby backflow moving in the flow passage of the conduit portion impinges on the flow plate so as to urge the flow plate in movement around the third axis in a first direction from the closed position towards the first open position.

In one form, the flow plate has opposite sides and combustion gases moving in the first path and the first direction cause the generation of a low pressure region in the flow passage that produces a pressure differential on opposites sides of the flow plate. The pressure differential urges the flow plate in movement around the third axis in a direction opposite to the first direction from the closed position towards a second open position.

In one form, the flow space in the first conduit length has a larger diameter portion and a smaller diameter portion. The intake air moves through the L-shaped conduit directly into the smaller diameter portion of the flow space. The combustion gases move in the larger diameter portion of the flow space and are diverted into the smaller diameter portion of the flow space at a mixing location.

In one form, at the mixing location, the first conduit length has a first section with a first diameter that bounds the larger diameter portion of the flow space and a second section with a second diameter that bounds the smaller diameter portion of the flow space. The first section of the first conduit length extends around at least one of the first leg and second section of the first conduit length so as to define and intermediate space, whereby a combustion gas moving in the first path and in the first direction moves through the intermediate space and from the intermediate space radially inwardly into the smaller diameter portion of the flow space.

The outlet/inlet may be substantially centered within the flow space so that the intermediate space is defined fully around the outlet/inlet.

In one form, the conduit assembly has a plate that blocks movement of a fluid moving oppositely to the first direction into the intermediate space.

The conduit system may further include at least one opening/gap through the first leg through which communication between the larger and smaller diameter portions of the flow space can occur.

In one form, the L-shaped conduit has a substantially uniform first diameter that is substantially the same as the diameter of the second portion of the first conduit length, and the conduit assembly has substantially the first diameter fully between the outlet/inlet and the vent outlet.

In one form, the flue outlet is directly connected to the vent assembly so that the flow space is bounded by the conduit assembly fully between the flue outlet and the vent outlet.

The mixing assembly may define a spacer to maintain a predetermined spaced relationship between the first section of the first conduit length and the second section of the first conduit length.

The outlet/inlet may intercept substantially all of the backflow.

DETAILED DESCRIPTION OF THE DRAWINGS

Figure 1:
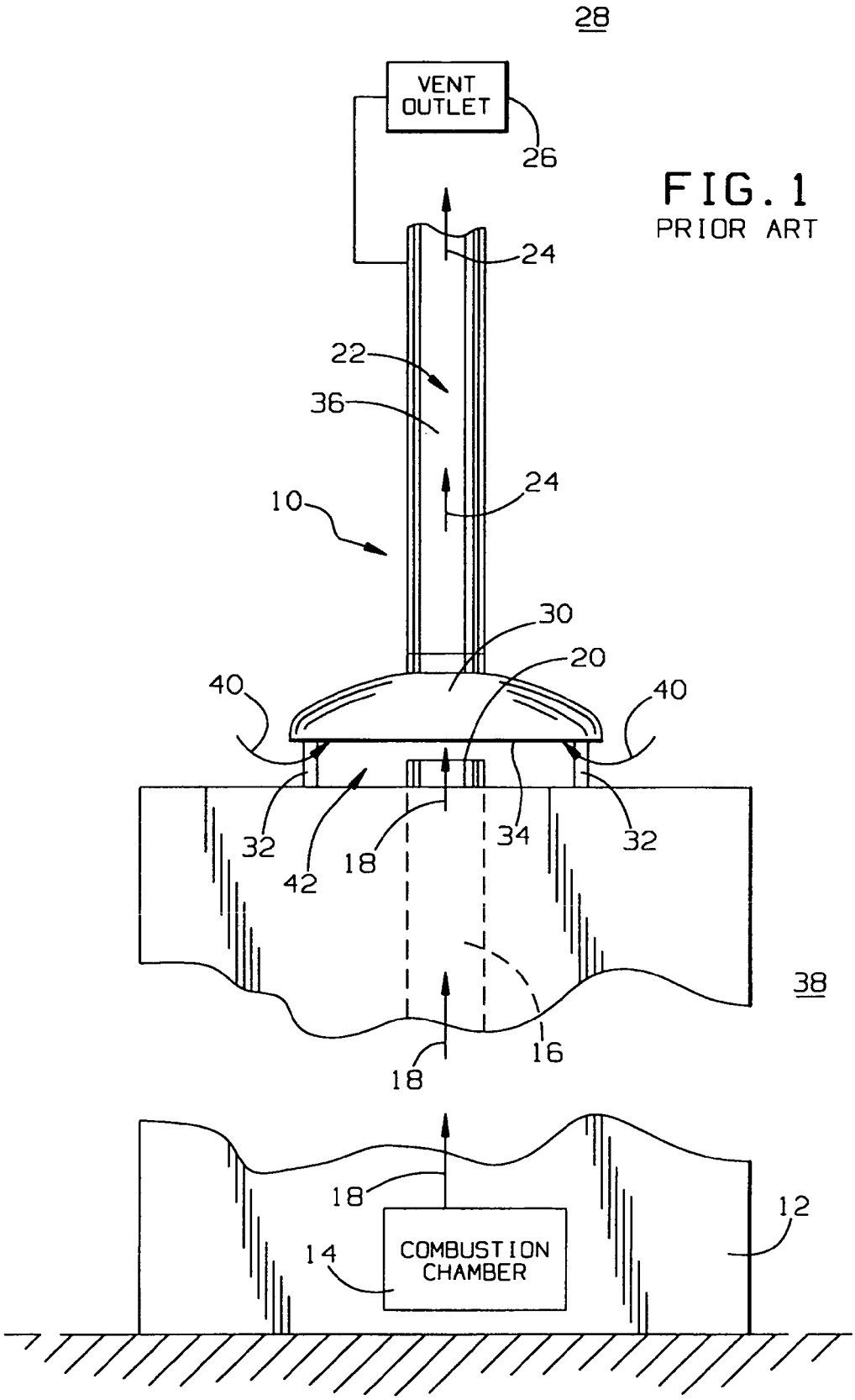
FIG. 1 PRIOR ART
FIG. 1 is a partially schematic representation of an appliance utilizing a conventional, hooded vent assembly and with the overall system in a normal operating state.

In FIG. 1, one type of conventional vent assembly is shown at 10 in association with an appliance 12 that produces combustion gases during operation thereof. As one example, the appliance 12 may be a conventional water heater having a combustion chamber 14 in which a fuel is burned, as a result of which combustion gases are generated. The combustion gases are communicated by a flue 16 from the combustion chamber 14, in the direction of the arrows 18, and discharged from the appliance 12 at a flue outlet 20.

The vent assembly 10 consists of a conduit assembly 22 that communicates the combustion gases discharged from flue 16 of the appliance 12 in the direction of the arrows 24, to and from a vent outlet 26 and into a selected space 28 at a desired location.

In this embodiment, the conduit assembly 22 is "decoupled" from the flue 16. To accumulate the discharging combustion gases from the flue outlet 20, an inverted, cup-shaped hood 30 is provided at a location spaced above the flue outlet 20. The hood 30 is supported by an appropriate base 32 to reside in vertically spaced relationship with the flue outlet 20. That is, the hood inlet 34 is spaced above the flue outlet 20.

In operation, the rising heated combustion gases flowing in the conduit assembly 22 generate draft that draws the combustion gases 14 from the flue 16 into the hood 30, through which they are funneled into a substantially uniform diameter conduit 36 that communicates between the hood 30 and the vent outlet 26.

The generated draft also draws intake/dilution air from a space 38, within which the appliance 12 resides, into the hood 30, in the direction of the arrows 40 through substantially 360° around the hood 30. The spaced relationship between the flue outlet 20 and hood inlet 34 creates a space 42 for the passage of the intake/dilution air.

Figure 2:
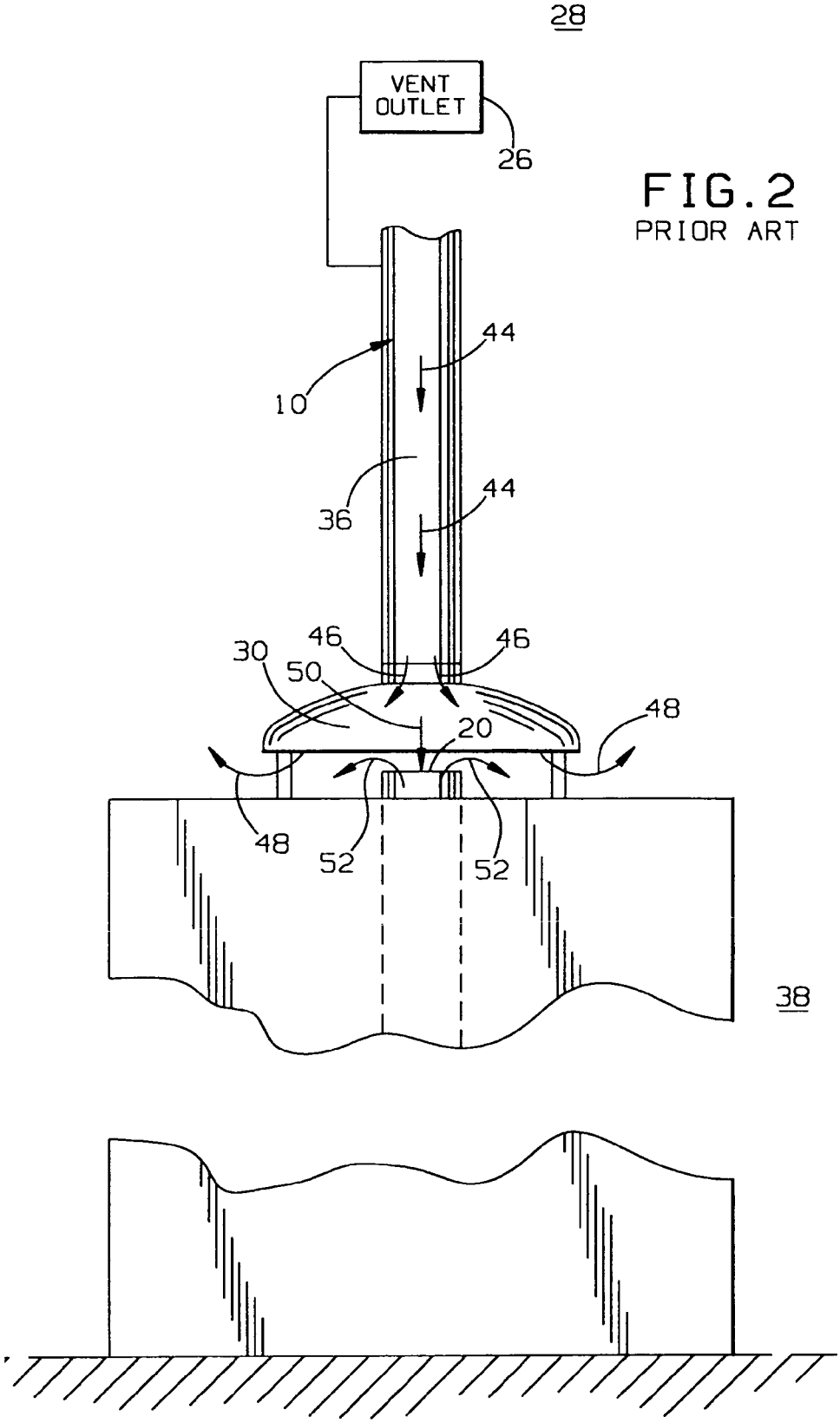
FIG. 2 PRIOR ART
FIG. 2 is a view as in FIG. 1 wherein the system is in a downdraft state wherein backflow occurs in the vent assembly.

As explained in the Background Art section hereinabove, the conventional vent assembly 10, as in FIG. 1, has one particular drawback, as will now be described with respect to FIG. 2. As relative pressure conditions within the spaces 28, 38 create a downdraft condition, backflow occurs in the conduit 36 on the vent assembly 10. This backflow pattern is indicated by the arrows 44, 46, 48. As indicated by the arrows 44, the backflow is initially vertically downwardly. At the hood 30, the flow expands to the contours thereof, as indicated by the arrows 46 and, as indicated by the arrows 48, discharges into the space 38. A substantial volume of the air traveling vertically downwardly, that does not disperse in the direction of the arrows 46, 48, impinges directly upon the flue outlet 20, as indicated by the arrow 50. This produces a "capping pressure" at the outlet 20 that obstructs, either partially or fully, the flow of combustion gases from the flue outlet 20 towards the vent assembly 10. This condition may cause a state that efficient combustion is substantially impaired or, in a worst case, flame-out.

A still further consequence of this high capping pressure is that the combustion gases discharging from the flue outlet 20 tend to be diverted as spillage into the space 38, as indicated by the arrows 52. In a worst case, significant amounts of the flue gas may be detrimentally introduced to the space 38.

The pressure relief afforded by the de-coupling of the hood 30 tends to reduce the magnitude of the capping pressure. However, by reason of de-coupling the hood 30, the bounded venting space for the combustion gases is not continuous from the combustion chamber 14 to the vent outlet 26. As a result, the overall venting efficiency of the appliance may be less than desirable.

Figure 3:
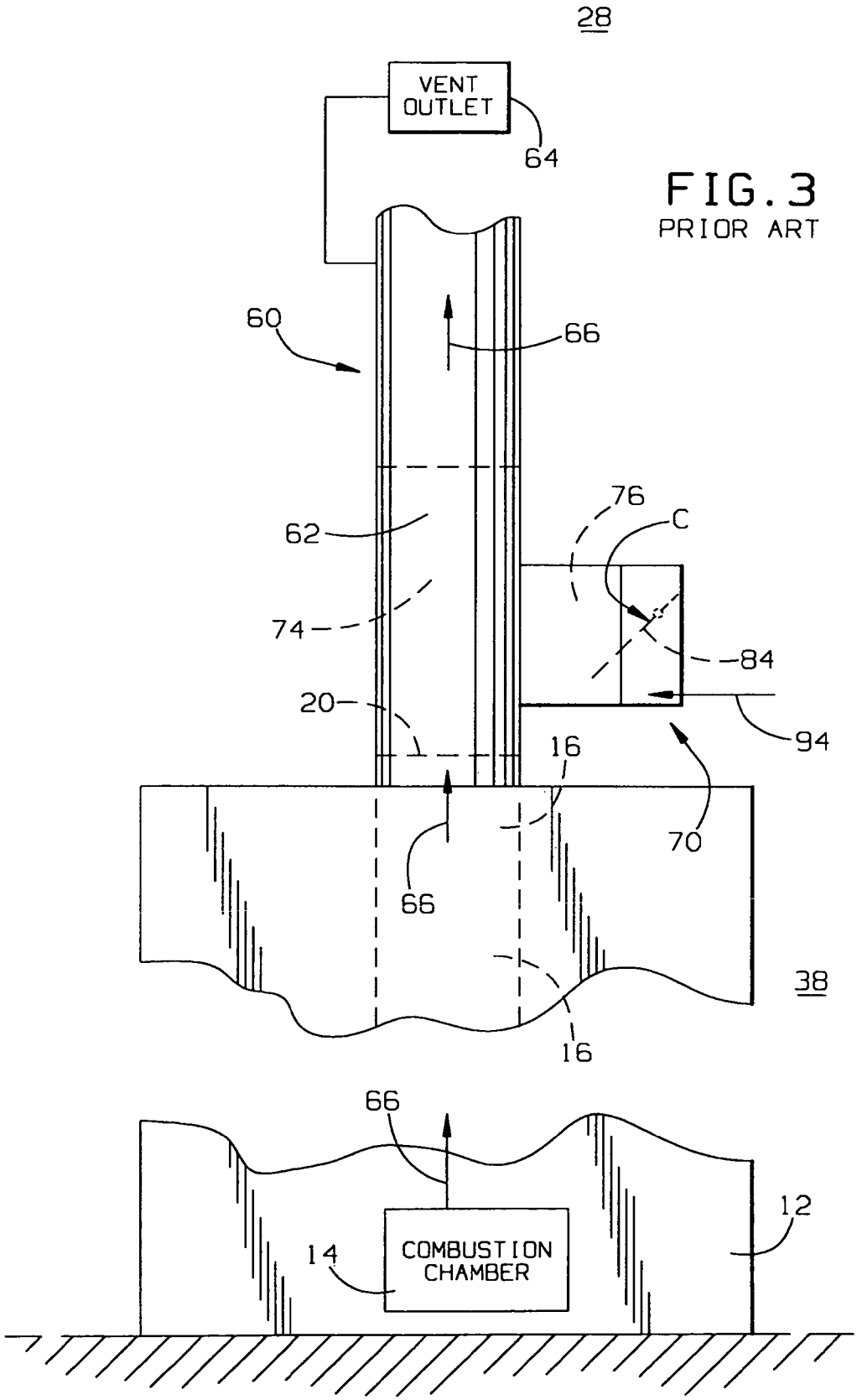
FIG. 3 PRIOR ART
FIG. 3 is a view as in FIGS. 1 and 2 of a modified form of conventional vent assembly, and with the system in a normal operating state.
Figure 4:
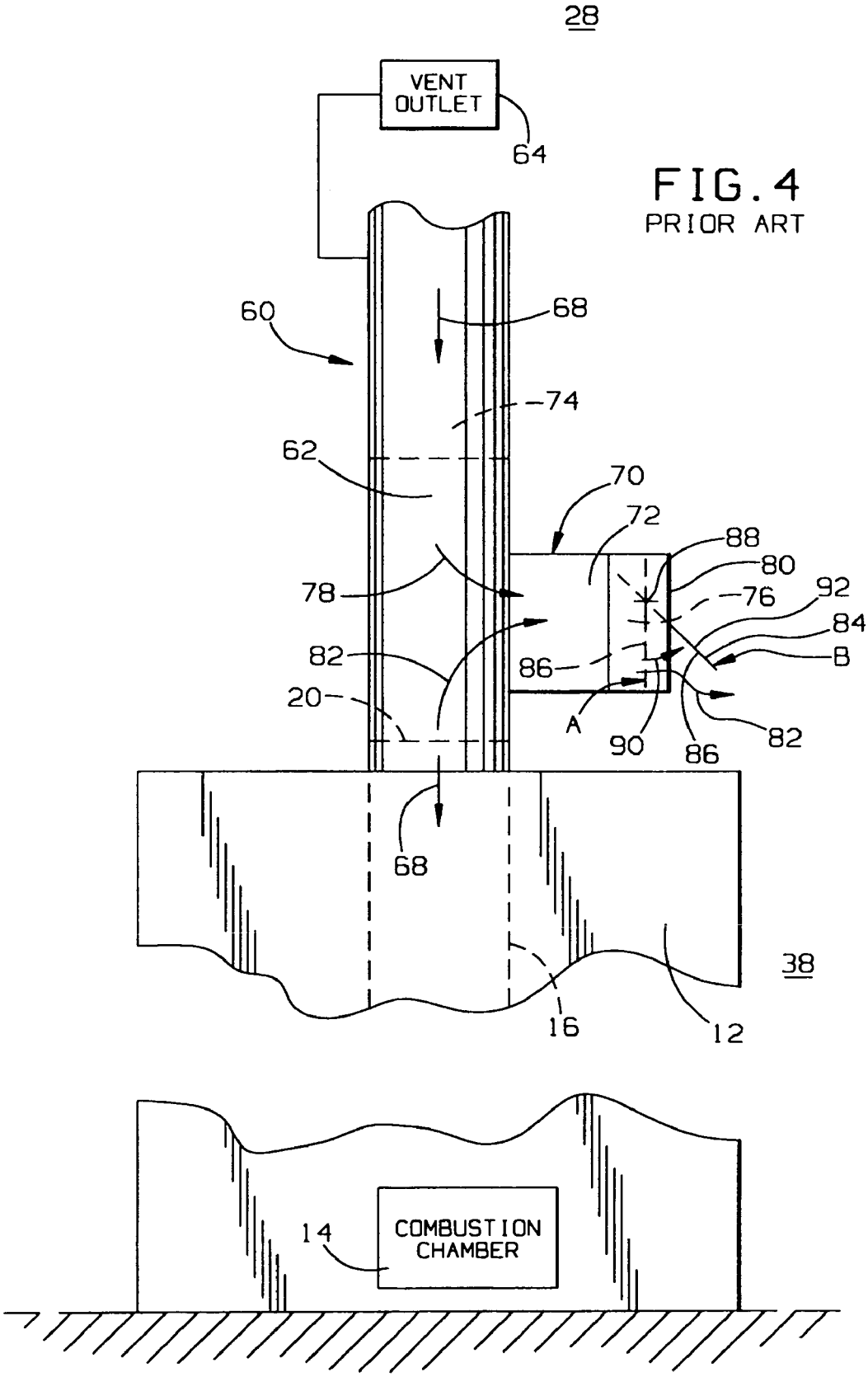
FIG. 4 PRIOR ART
FIG. 4 is a view as in FIG. 3 wherein the system is in a downdraft state.

To provide additional draft, and thereby improve venting efficiency, it is known, as described in the Background Art section herein, to directly couple the flue outlet 20 to a vent system 60, as shown in association with the appliance 12 in FIGS. 3 and 4. The vent system 60 consists of a conduit 62 that is directly coupled to the flue 16 at the outlet 20 to define a continuous bounded communication path between the combustion chamber 14 and a vent outlet 64. As a result, the draft height extends from the combustion chamber 14 to the vent outlet 64, which potentially contributes to efficient venting of the appliance 12. Combustion gases generated in the chamber 14 are communicated to the vent outlet 64 through the flue 16 and conduit 62 in a substantially straight line, as indicated by the arrows 66, as shown in FIG. 3.

As described in the Background Art section hereinabove, the vent system 60, while contributing potentially to efficient vent operation, may be responsible for problems when there is a downdraft condition experienced as a result of relative pressure conditions between the spaces 28, 38. As seen in FIG. 4, the downdraft condition may result in a downward backflow, as indicated by the arrows 68. In the absence of some type of additional control, the backflow could produce a very substantial capping pressure at the flue outlet 20. To alleviate this condition, to at least a certain extent, a draft control assembly is provided at 70.

The draft control assembly 70 consists of a transverse conduit portion 72, joined to the conduit 62 so that the vertical flow space 74 defined by the conduit 62 is in communication with a transverse flow passage 76 bounded by the conduit portion 72. So long as the pressure in the space 38 is less than that of the backflowing air in the vertical flow space 74, the back flowing air will divert, as indicated by the arrow 78, into the passage 76 to be exhausted at a backflow outlet 80 on the conduit portion 72 into the space 38 at a desired location. As this occurs, the backflow creates a lower pressure region in the flow passage 76 that tends to divert much of the discharging combustion gases in the direction of the arrow 82 through the flow passage 76 and into the space 38. Additionally, the substantial pressure from the backflow produces a significant capping pressure at the flue outlet 20 which may interfere with appliance operation and, in a worst case, cause flame-out.

Unobstructed flow of air/gas to and through the flow passage 76 from the conduit 62/space 38 is controlled by a movable plate 84 that is configured to substantially block the outlet 80 on the conduit portion 72 with the plate 84 in a closed state, as shown in dotted lines at A in FIG. 4. As shown in FIG. 4, the backflow and diverted combustion gases impinging upon a first side 86 of the plate 84 cause the plate 84 to pivot around an axis 88 in the direction of the arrow 90, from the closed position to a first open position, shown at B. The axis 88 is off center to move in response to conditions wherein there is a pressure differential causing unequal forces to be generated on the one side 88 and on a second, opposite side 92.

When there is not a downdraft condition, operation of the appliance 12, as shown in FIG. 3, causes the combustion gases to create a negative pressure in the flow passage 76, whereby the pressure in the flow passage 76 is less than that of the pressure in the space 38. This causes a pressure differential that pivots the plate 84 from the closed position into a second open position, as shown at C in FIG. 3, wherein dilution air is drawn in from the space 38 in the direction of arrow 94 into the flow passage 76 and therefrom into the vertical flow space 74 to be mixed with the combustion gases and flow therewith in the direction of the arrows at 66 for discharge at the vent outlet 64.

As noted above, the principle drawback with the vent system 60 in FIGS. 3 and 4 is that a substantial capping pressure may be produced under downdraft conditions. The unobstructed vertical path between the vent outlet 64 and flue outlet 20 may produce this condition even with the presence of the draft control assembly 70. That is because there is an unimpeded vertical path for the backflow directly from the vent outlet 64 to the flue outlet 20.

A preferred form of vent assembly, according to the present invention, is shown at 100 in FIGS. 5-10. The vent assembly 100 is depicted on the same appliance 12, previously described as a water heater. However, the vent assembly 100 can be used on any type of appliance that produces combustion gases during operation thereof that must be directed out of the space 38 within which the particular appliance is operated. Typically, the appliance will be operated in the space 38 internally of an enclosure and the vent assembly 100 will direct the combustion gases to a vent outlet 102 that is external to the enclosure for the space 38 and to the space 28. This is not a requirement, however.

Figure 5:
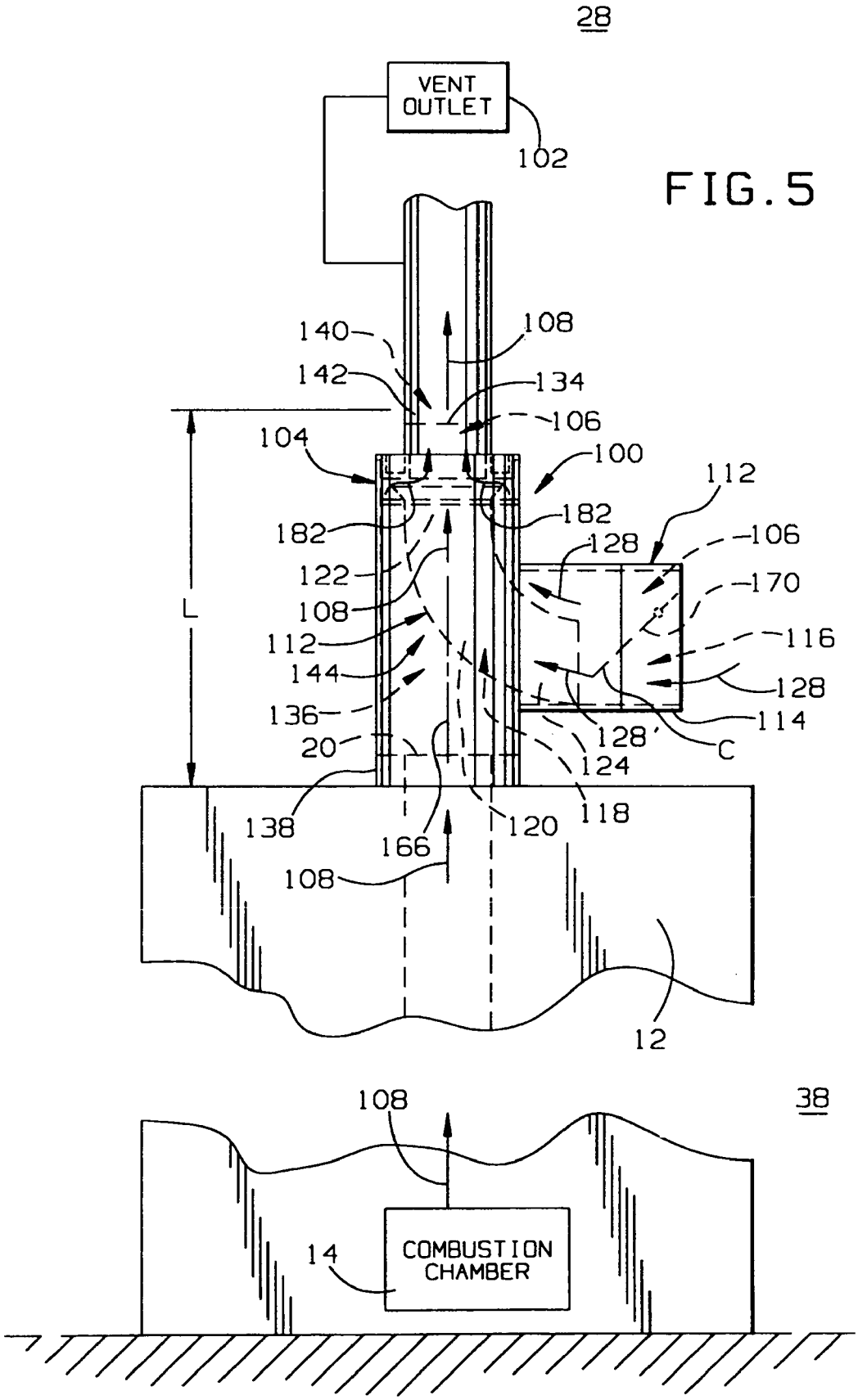
FIG. 5 is a view as in FIGS. 1-4 showing the inventive vent assembly with the system in a normal operating state.

The vent assembly 100 consists of a conduit assembly at 104 bounding a flow space 106 which, under a first set of conditions, as shown in FIG. 5, communicates gases generated by operation of the appliance 12 from the combustion chamber 14 in the direction of the arrows 108 to the flue outlet 20 and, from the flue outlet 20 vertically to and through the vent outlet 102 to a desired location in the space 28. The conduit assembly 104 has a straight length extending from the flue outlet 20 in a vertical direction fully to the outlet 102.

Figure 6:
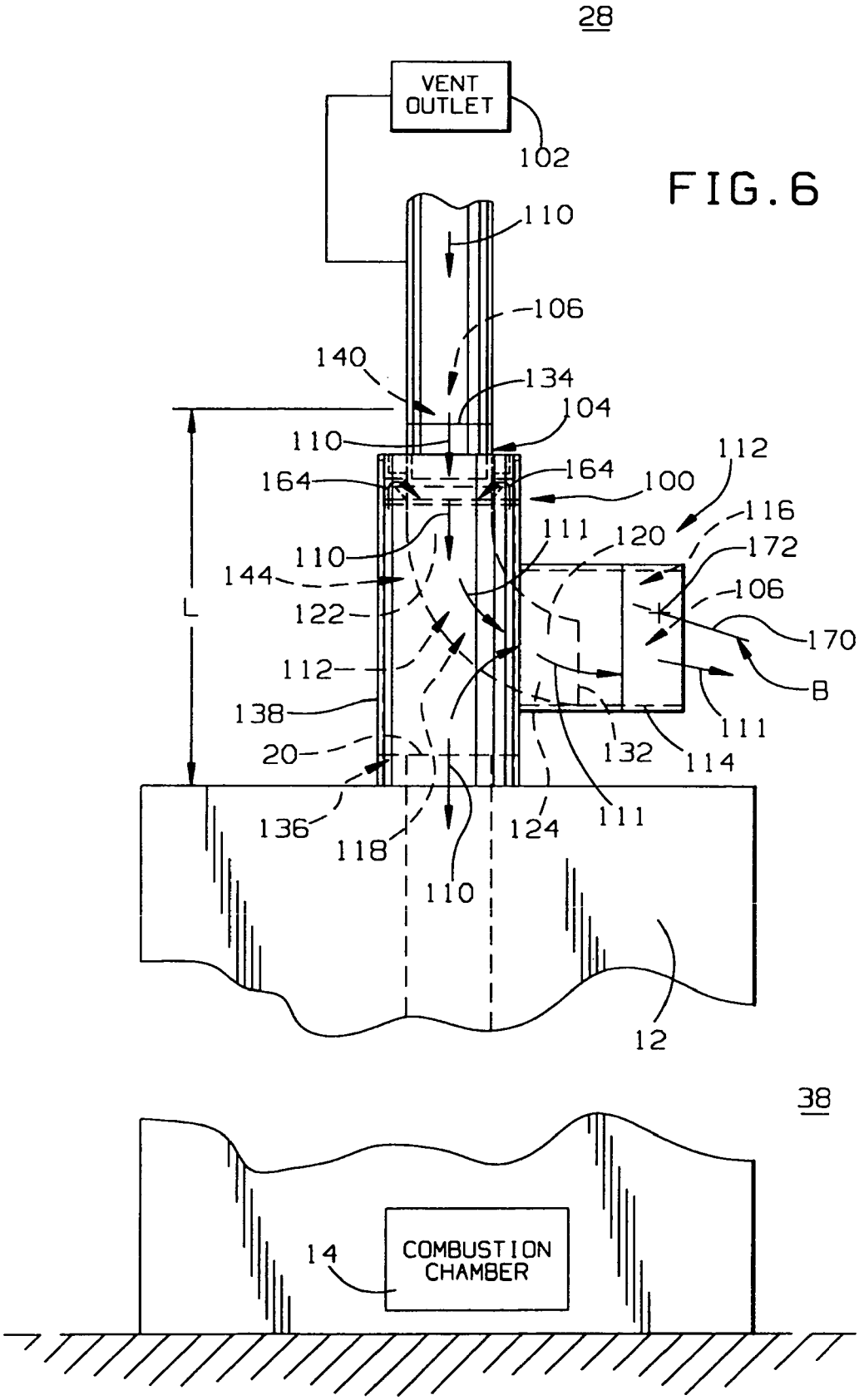
FIG. 6 is a view as in FIG. 5 wherein the system is in a downdraft state.
Figure 8:
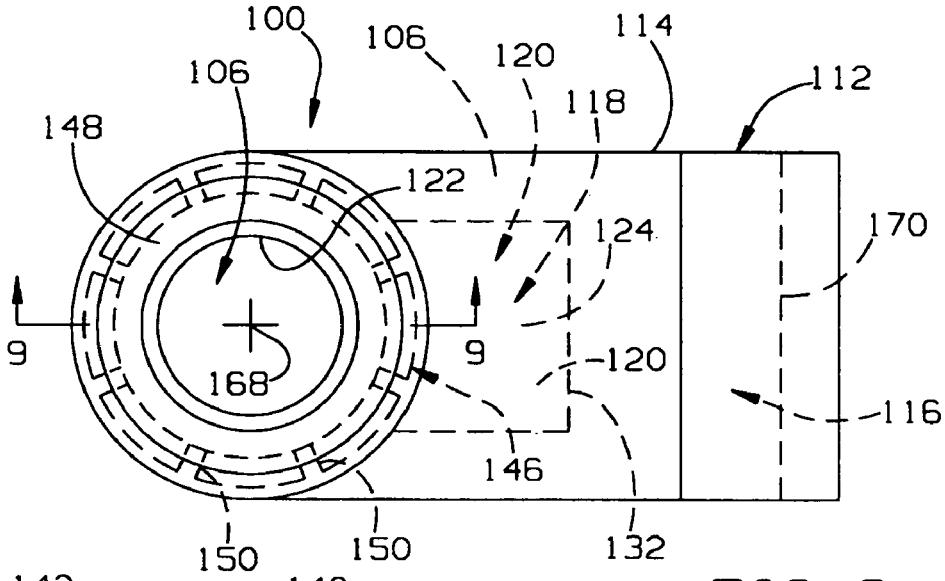
FIG. 8 is an enlarged, plan view of the portion of the vent assembly in FIG. 7.

In a separate system state, under downdraft conditions as shown in FIG. 6, air is communicated downwardly in the flow space 106 from the space 28 in the direction of the arrows 110 from the vent outlet 102, and guidingly diverted in the direction of the arrows 111 to and through a draft control assembly 112 into the space 38.

The conduit assembly 104 has an arbitrary first conduit length L, within which: a) the combustion gases are communicated in a first direction, as indicated by the arrows 108, in a first path between the flue outlet 20 and the vent outlet 102; and b) backflow is communicated in the first path in a direction opposite to the first direction, as indicated by the arrows 110. The conduit assembly 104 further includes the aforementioned draft control assembly 112. The draft control assembly 112 consists of a conduit portion 114 defining a flow passage 116 in which backflow diverted out of the first path is exhausted into the space 38 at a second location.

The draft control assembly 112 further includes a flow guide assembly 118 within the flow space 106. The flow guide assembly 118 consists of an L-shaped conduit 120, with a first leg 122 residing in the flow space 106 within the first conduit length L, and a second leg 124 residing within the flow passage 116 within the conduit portion 114.

The conduit 120 has a curved surface 126 that intercepts and guidingly redirects backflow, moving in the first path in the direction of the arrows 110, into the flow passage 116 in the conduit portion 114, as indicated by the arrows 111, from where the backflow is exhausted to the space 38. The surface 126 likewise guides a portion of the intake/dilution air introduced from the space 38 and moving in the direction of the arrows 128 into the flow passage 116, that is intercepted by the conduit 120, as indicated by the arrow 128', into the first conduit length L in which the intake/dilution air is mixed with combustion gases and thereafter moves with the combustion gases in the first path in the direction indicated by the arrows 108.

The second leg 124 has an opening 132, hereinafter described as an inlet/outlet 132. The inlet/outlet 132 defines an inlet for intake/dilution air from the space 38, with the overall system in the state shown in FIG. 5, and an outlet for backflow, with the overall system in the FIG. 6 state.

The first leg 122 has an opening 134, hereinafter identified as an outlet/inlet 134, which is above the inlet/outlet 132 and functions as an outlet for intake/dilution air, with the overall system in the FIG. 5 state, and an inlet for backflow, with the overall system in the FIG. 6 state. The curved surface 126 guides and redirects backflow and intake/dilution air between the inlet/outlet 132 and outlet/inlet 134.

The flow space 106, along the conduit length L, has a larger diameter portion at 136 bounded by a first conduit section 138, and a smaller diameter portion 140 bounded by a second conduit section 142.

The intake/dilution air moves through the L-shaped conduit 120 in FIG. 5 from the outlet/inlet 134 directly into the smaller diameter portion 140 of the flow space 106. Combustion gases, moving in the first path in the direction of the arrow 108 through the larger diameter portion 136 of the flow space 106, move from the flue outlet 20 and to an intermediate space 144, defined between the conduit section 138 and first leg 122, where the first conduit section 138 surrounds the first leg 122.

Flow through the intermediate space 144 is controlled by a mixing assembly 146 at a mixing location. The mixing assembly 146, as shown most clearly in FIGS. 7-10, consists of a top, ring-shaped cap 148, and a bottom, ring-shaped spacing plate 149, with through openings 150 regularly spaced therearound. The cap 148 fits snugly into the top of the conduit section 138 and has an outturned flange 151 that bears on the top edge 152 thereof to consistently maintain the vertical location of the cap 148 relative to the conduit section 138. The cap 148 has a solid annular wall/plate 153 that blocks passage of backflow air into the intermediate space 144. A collar 154 extends from the wall/plate 153 to couple with the second conduit section 142. While the cap 148 on the flow guide assembly 118 is shown to be separate from the second conduit section 142, the cap 148 could be integral therewith so that the outlet/inlet 134 has no specific, identifiable transition location.

A part of the conduit leg 124 terminates at a flared end 155 that is spaced slightly below a bottom opening 156 in a through passage 157 defined by the cap 148, whereby a vertical gap/opening G exists therebetween. The passage 157 has a diameter that is substantially equal to the diameter of the passage 158 bounded by the conduit surface 126. The flaring of the conduit end 155 produces a funnel-shaped surface portion 159, opening upwardly.

Combustion gases moving in the first direction and the first path move into the intermediate space 144 and through the openings 150, after which they encounter the wall/plate 153 and are thereby caused to be diverted radially into the gap G and into the smaller diameter conduit portion 140, from where they move vertically in the first path towards the vent outlet 102.

Figure 7:
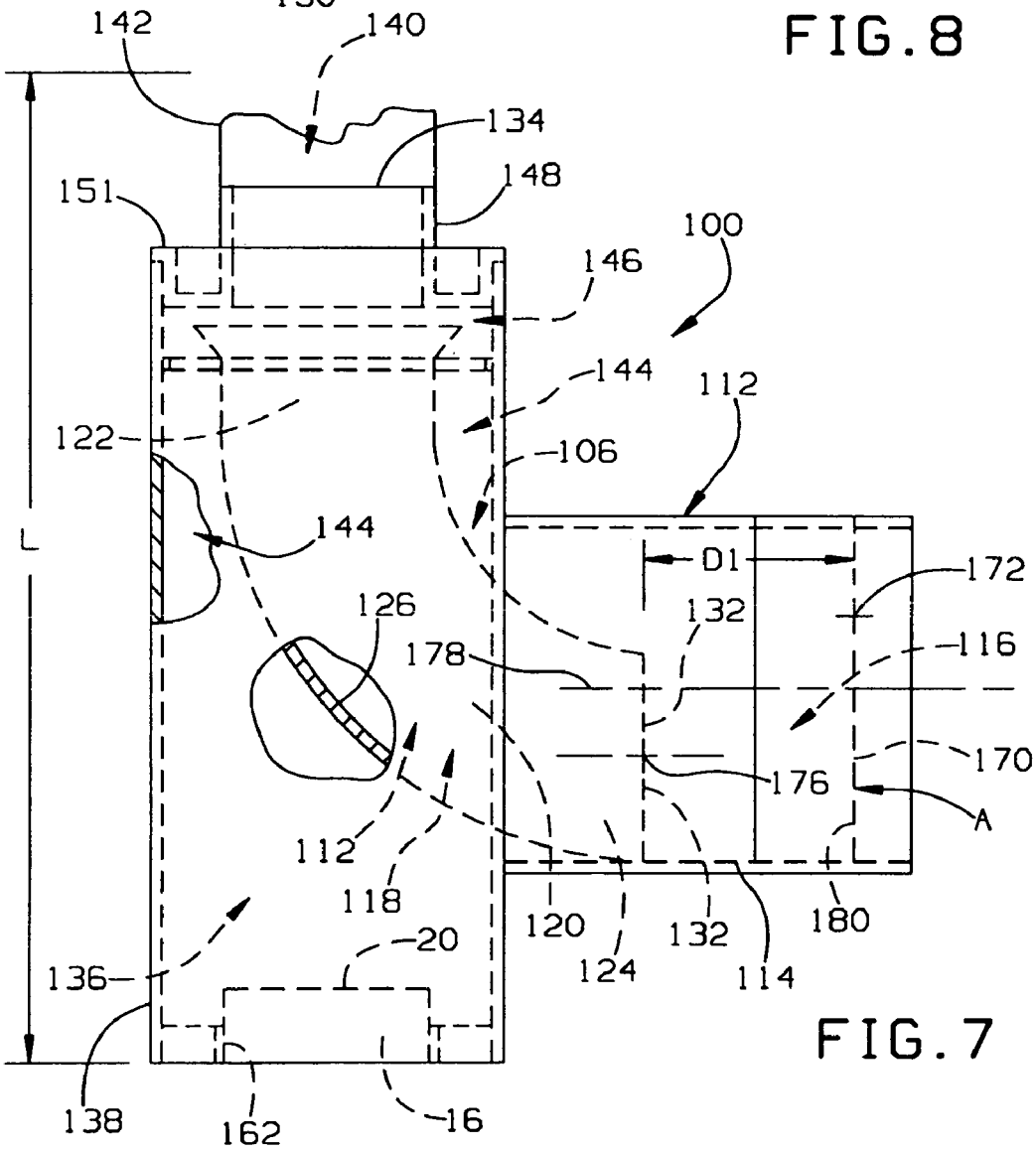
FIG. 7 is an enlarged, fragmentary, elevation view of a portion of the vent assembly in FIGS. 5 and 6.

The bottom plate 149 may be pre-assembled to the conduit 120 at the flared end 155 to define a unit that can be slid downwardly into the conduit section 138 to the operative position shown in FIG. 7, wherein the conduit leg 124 rests upon the conduit portion 114 for consistent vertical location thereof. The plate 149 centers the conduit leg 122 in the conduit section 138. The cap 148, that may be made as one piece, or from a plurality of joined pieces, is thereafter pressed into the operative position of FIG. 9 in which the flange 151 bears on the top edge 152 of the conduit section 138 to consistently locate the cap 148 to maintain a consistent gap (G) dimension.

With this arrangement, the combustion gases can be conveyed through the larger first conduit section 138 and openings 150 and thereafter encounter the solid wall/plate 153 and are thereby caused to be diverted radially inwardly around the edge 160 on the flared end 155 into and through the passage 157 and from there into the smaller diameter second conduit section 142 with the overall system in the FIG. 5 state. With a downdraft condition as in FIG. 6, virtually all of the volume of backflow air moves from the opening 156 at the bottom of the passage 157 and is funneled by the surface 159 to and guidingly through the remaining portion of the L-shaped conduit 120 and is thereby diverted into the space 38 through the draft control assembly 112, potentially without producing any detrimental capping pressure at the flue outlet 20. A small volume of the backflow air flows through the gap G radially outwardly and thereafter downwardly into and through the intermediate space 144, as indicated by the arrows 161 in FIG. 9.

The conduit section 138 has a connecter 162 that is directly joined to the flue 16 at the outlet 20 so that there is a continuous, bounded passage between the flue outlet 20 and the vent outlet 102. As a result, the draft height extends from the combustion chamber 14 fully to the vent outlet 102. This contributes to vent efficiency.

Even with a downdraft condition, shown in FIG. 6, a volume of combustion gases is permitted to move through the intermediate space 144 into and through the openings 150 in the bottom plate 149 and through the gap G and into the conduit passage 158 to be diverted through the draft control assembly 112 into the space 38. As indicated by the arrows 164 in FIG. 6, this flow of diverted gases is combined with the backflow that is discharged into the space 38. This avoids generation of a capping pressure that might be otherwise created through the captive discharged combustion gases and thereby potentially avoids incomplete combustion and, in a worst case, flame-out.

The L-shaped conduit 120 is shown with a uniform diameter throughout, including at the inlet/outlet 132 and outlet/inlet 134. Preferably, the portion of the flow space 106 defined by the conduit 120 is substantially circular in cross section. The portion of the flow space 106 bounded by the first conduit section 138 is likewise preferably circular. However, it is not a requirement that either cross-sectional area be circular.

It is also preferable, but not required, that the central axis 166 for the first conduit section 138 be coincidental with the central axis 168 for the conduit leg 122. This centering is accomplished by the bottom spacing plate 149. Thus, the intermediate space 144 has a substantially uniform radial dimension fully around the conduit leg 122.

The draft control assembly 112 has a plate 170, corresponding to the plate 84, previously described, that is movable about an axis 172 from the corresponding closed position as shown at A in FIG. 7, into first and second open positions as shown respectively at B and C in FIGS. 6 and 5.

The second conduit leg 124 is situated within the flow passage 116 so that the inlet/outlet 132 is spaced a substantial distance D1 from the closed plate 170. Further, the central axis 176 of the inlet/outlet 132 is spaced below the central axis 178 of the flow passage 116. Accordingly, the backflow is caused to impinge primarily on an area at one side 180 of the plate 170 below the pivot axis 172. This concentrated force below the axis 172 produces a substantial torque on the plate 170, tending to pivot the plate 170 towards the first open position at B in the downdraft state of FIG. 6. Consequently, the plate 170 may move quickly in response to the backflow condition.

With the system in the FIG. 5 state, the discharging gases will produce a low pressure region in the second conduit leg 124 and at the plate side 180, initially primarily in the region below the axis 172. A resulting pressure differential tends to cause the plate 170 to be pivoted from the closed position to the second open position at C in FIG. 5. Again, by locating the inlet/outlet opening 132 as shown, the response time is relatively short for the repositioning of the plate 170 once a change of the system state occurs, to thereby cause the introduction and mixing of intake/dilution air.

Additionally, a smaller volume of the intake/dilution air flows from the space 38 through the flow passage 116 into the intermediate space 144, for mixing with the combustion gases, as indicated by the arrows 128 and additionally by the arrows 182.

In the preferred construction for the conduit portion 114, the flow passage 116 has a circular configuration, as does the inlet/outlet 132. However, this is not a requirement.

It should be understood that while the description herein relates to a preferred form of the invention, many variations thereof are contemplated. For example, the first conduit section 138 may extend upwardly to beyond the leg 122, including the cap 148, as opposed to the construction shown particularly on FIG. 7.

As another example, the configuration, number, and dimensions of the openings 150 need not be as shown.

As an alternative to making the cap 148 on the conduit 120 that defines the flow guide assembly 118 as a separate piece, these or other like functioning elements could be made as one integral unit. The function performed by the gap G could be performed by a plurality of strategically placed openings.

The flow guide assembly 112 can be configured in many different ways to perform the functions described for the L-shaped conduit 120. The L-shaped conduit 120 is but one exemplary form therefor.

While the outlet/inlet 134 is described to be on the cap 148, which functions to extend the effective vertical length of the conduit leg 122, the opening at the top of the flared end 155 on the conduit 120 may also be considered to be the "outlet/inlet" for purposes of the description and claims herein. As noted above, the cap 148 is considered to be an extension of the conduit leg 122 in the description and claims herein.

Figures 9, 10:
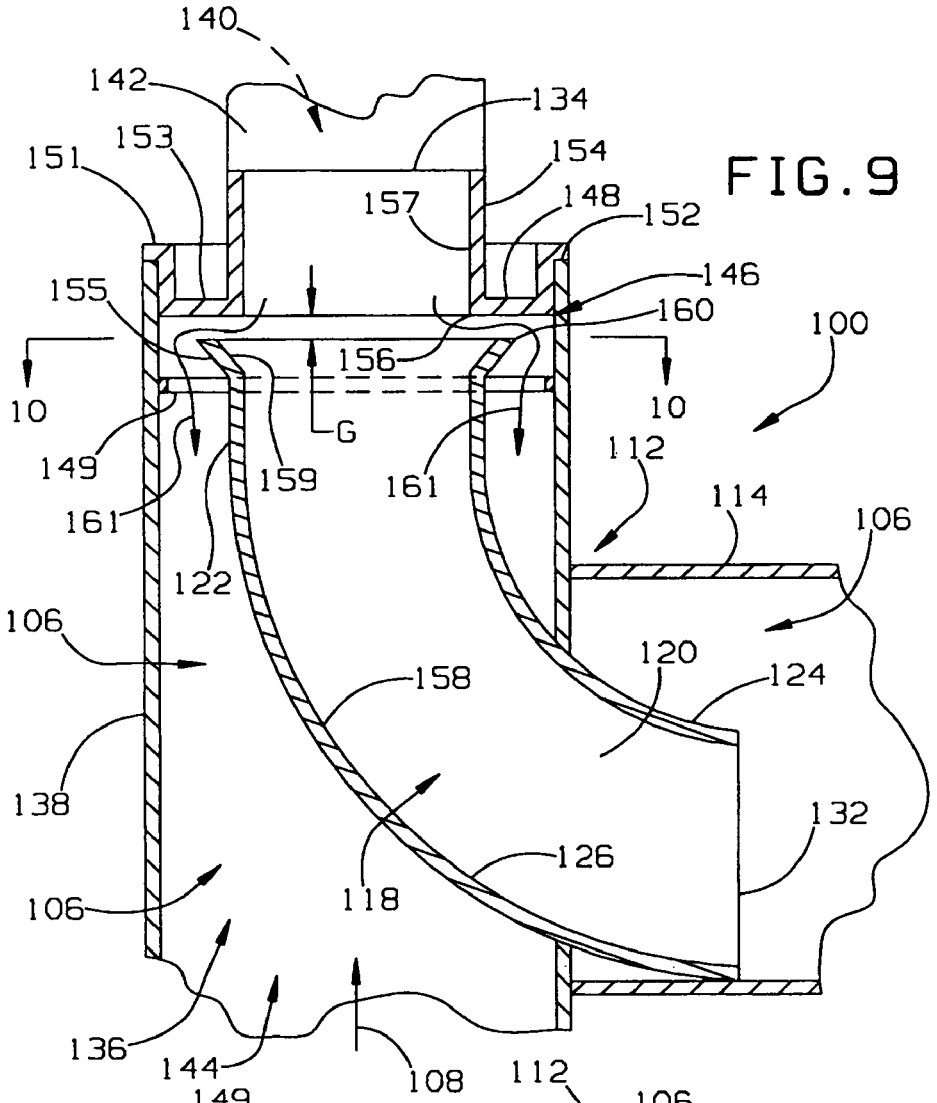
FIG. 9 is a cross-sectional view of the portion of the vent assembly taken along line 9-9 of FIG. 8.
FIG. 10 is a cross-sectional view of the portion of the vent assembly taken along line 10-10 of FIG. 9.
Figure 11:
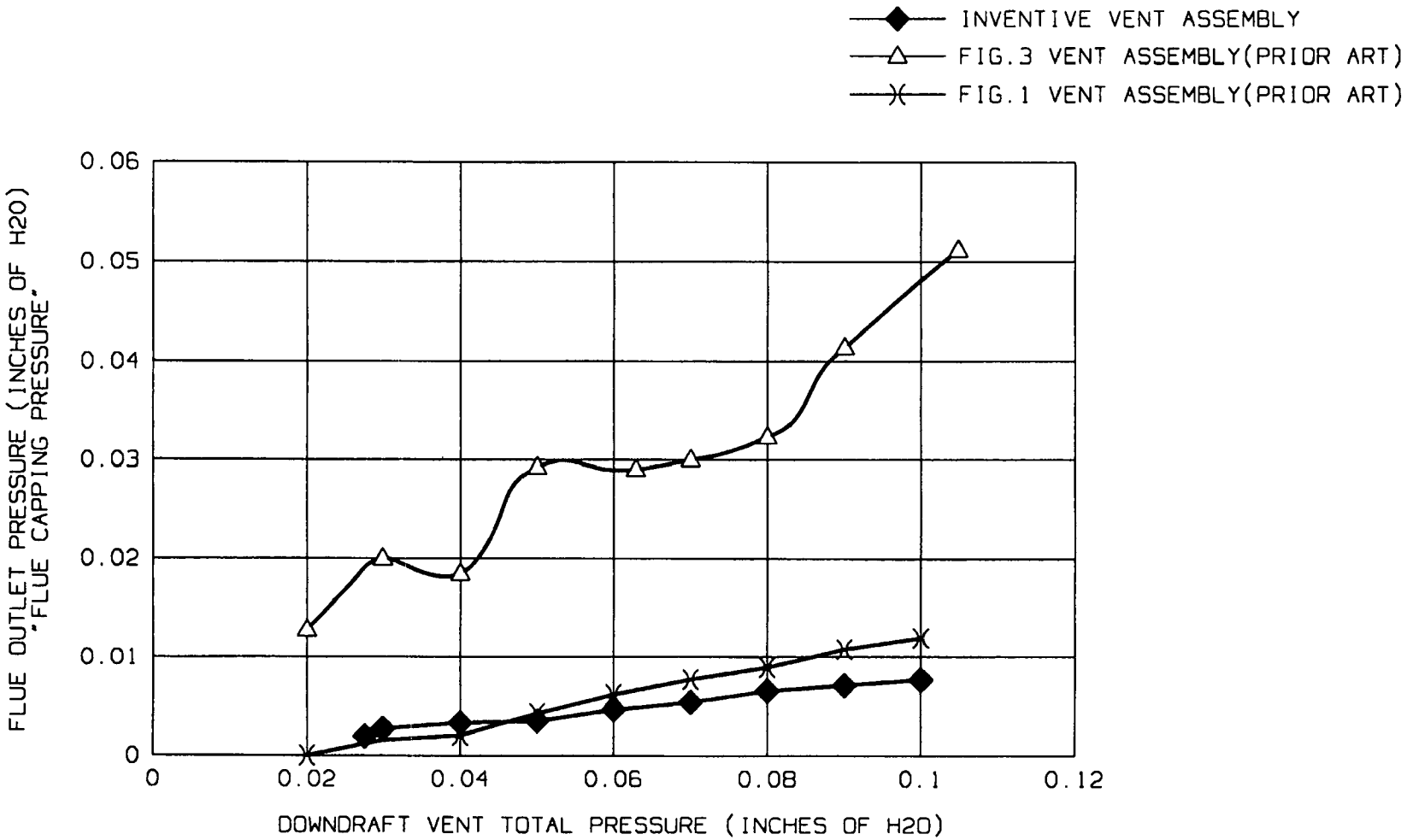
FIG. 11 is a graph showing the relationship between vent total pressure and flue outlet pressure/capping pressure for the inventive vent assembly and the prior art vent assemblies shown in FIGS. 1 and 3.

FIG. 9 is a graph showing a relationship between vent total pressure (caused by downdraft conditions), and flue outlet (capping) pressure for the inventive vent assembly 100 and those conventional assemblies shown in FIGS. 1 and 3. It can be seen that the capping pressure with the vent assembly in FIG. 3 increases greatly with vent total pressure. The inventive vent assembly controlled capping pressures over a wide range of vent total pressures in a range comparable to that resulting from use of the hooded system in FIG. 1. At the same time, by reason of the direct connection of the vent system to the flue outlet, a substantial vertical draft height is afforded with the inventive vent assembly that makes possible efficient venting operation of the associated appliance.

The foregoing disclosure of specific embodiments is intended to be illustrative of the broad concepts comprehended by the invention.

The invention claimed is:

1. In combination:

a) an appliance that produces combustion gases during operation and having a flue outlet through which the combustion gases are discharged from the appliance; and b) a vent assembly comprising:

a conduit assembly bounding a flow space into which discharged combustion gases from the flue outlet are communicated and from which the discharged combustion gases are exhausted through a vent outlet to a first location, the conduit assembly comprising a first conduit length in which a) the combustion gases are communicated in a first direction in a first path between the flue outlet and the vent outlet; and b) backflow is communicated in the first path in a direction opposite to the first direction, the conduit assembly further comprising a draft control assembly, the draft control assembly comprising a conduit portion defining a flow passage that is part of the flow space and in which backflow is diverted out of the first path and exhausted to a second location that is spaced from the first location, wherein the draft control assembly further comprises a flow guide assembly within the flow space, the flow guide assembly defining a surface for intercepting backflow, moving in the first path opposite to the first direction toward the flue outlet, and through the surface guidingly changing a direction of movement of the intercepted backflow and thereby diverting the backflow into the conduit portion to be exhausted to the second location wherein the conduit assembly has a straight length extending from the flue outlet to and past the flow guide assembly.

2. The combination according to claim 1 wherein the surface on the flow guide assembly comprises a curved surface that guides: a) the backflow from the first path into the flow passage in the conduit portion from where the backflow is exhausted to the second location; and b) intake air introduced at the second location into the flow passage in the conduit portion into the first conduit length where the intake air is mixed with combustion gases and moves with the combustion gases in the first path in the first direction.

3. The combination according to claim 2 wherein the flow guide assembly comprises an L-shaped conduit having first and second legs, the first leg residing in the flow space within the first conduit length, the second leg residing within the flow passage within the conduit portion.

4. The combination according to claim 3 wherein the first leg has an air outlet/inlet and the second leg has an inlet/outlet and the curved surface guides the backflow intake/air between the outlet/inlet and inlet/outlet.

5. The combination according to claim 4 wherein the outlet/inlet resides above the inlet/outlet.

6. The combination according to claim 4 wherein the outlet/inlet has a cross-sectional area and a portion of the flow space within which the first leg resides has a cross-sectional area that is greater than the cross-sectional area of the outlet/inlet.

7. The combination according to claim 6 wherein the outlet/inlet has a substantially circular cross-sectional configuration with a first central axis, the flow space has a substantially circular cross-sectional configuration with a second central axis where the first leg resides in the flow space, and the first and second axes are substantially concentric.

8. The combination according to claim 4 wherein the inlet/outlet has a first central axis and the flow passage has a second central axis and the first and second central axes are spaced from each other.

9. The combination according to claim 8 wherein the inlet/outlet and flow passage each has a substantially circular cross-sectional configuration.

10. The combination according to claim 8 wherein the second central axis resides below the first central axis.

11. The combination according to claim 10 wherein the draft control assembly further comprises a flow plate that is pivotable about a third axis between a closed position and a first open position, the third axis transverse to the second central axis.

12. The combination according to claim 11 wherein the second central axis resides below the third axis whereby backflow moving in the flow passage of the conduit portion impinges on the flow plate so as to urge the flow plate in movement around the third axis in a first direction from the closed position towards the first open position.

13. The combination according to claim 12 wherein the flow plate has opposite sides, the combustion gases moving in the first path in the first direction cause the generation of a low pressure region in the flow passage that produces a pressure differential on opposite sides of the flow plate, and the pressure differential urges the flow plate in movement around the third axis in a direction opposite to the first direction from the closed position towards a second open position.

14. The combination according to claim 8 wherein the flow space in the first conduit length has a larger diameter portion and a smaller diameter portion, the intake air moves through the L-shaped conduit directly into the smaller diameter portion of the flow space and the combustion gases move in the larger diameter portion of the flow space and are diverted into the smaller diameter portion of the flow space at a mixing location.

15. The combination according to claim 14 wherein at the mixing location, the first conduit length has a first section with a first diameter that bounds the larger diameter portion of the flow space and a second section with a second diameter that bounds the smaller diameter portion of the flow space, the first section of the first conduit length extends around at least one of the first leg and second section of the first conduit length so as to define an intermediate space and combustion gases moving in the first path in the first direction move through the intermediate space and from the intermediate space radially inwardly into the smaller diameter portion of the flow space.

16. The combination according to claim 15 wherein the second section is substantially centered within the first section so that the intermediate space is defined fully around the outlet/inlet.

17. The combination according to claim 16 wherein the conduit assembly comprises a plate that blocks a fluid moving oppositely to the first direction from moving into the intermediate space.

18. The combination according to claim 16 wherein the conduit assembly comprises at least one opening/gap through the first leg through which communication between the larger and smaller diameter portions of the flow space can occur.

19. The combination according to claim 18 wherein the L-shaped conduit has a substantially uniform first diameter that is substantially the same as a diameter of the second portion of the first conduit length and the conduit assembly has substantially the first diameter fully between the outlet/inlet and the vent outlet.

20. The combination according to claim 1 wherein the flue outlet is directly connected to the vent assembly so that the flow space is bounded by the conduit assembly fully between the flue outlet and the vent outlet.

21. The combination according to claim 17 wherein the mixing assembly defines a spacer to maintain a predetermined spaced relationship between the first section of the first conduit length and the second section of the first conduit length.

22. The combination according to claim 4 wherein the outlet/inlet intercepts substantially all of the backflow.

23. The combination according to claim 1 wherein the conduit assembly has a straight length extending from the flue outlet and the surface defined by the flow guide assembly for intercepting backflow is located in the straight length of the conduit assembly.

24. The combination according to claim 21 wherein the straight length extends fully between the flue outlet and the vent outlet.

* * * * *